United States Patent [19]

Grabovac et al.

[11] Patent Number: 4,549,438

[45] Date of Patent: Oct. 29, 1985

[54] TORQUE MULTIPLYING TORQUE WRENCH

[75] Inventors: Bosko Grabovac, Arcadia; Ivan Vuceta, Walnut, both of Calif.

[73] Assignee: Consolidated Devices, Inc., City of Industry, Calif.

[21] Appl. No.: 516,777

[22] Filed: Jul. 25, 1983

[51] Int. Cl.[4] ..... B25B 23/142

[52] U.S. Cl. ..... 73/862.21; 73/862.31

[58] Field of Search ..... 73/862.21, 862.31

[56] References Cited

U.S. PATENT DOCUMENTS

| | | | |
|---|---|---|---|
| 2,550,693 | 5/1951 | Hart | 73/862.31 |
| 3,224,262 | 12/1965 | Shipley | 73/862.31 |
| 3,683,686 | 8/1972 | Sergan | 73/862.31 |
| 3,813,933 | 6/1974 | Weiss et al. | 73/862.21 |
| 4,188,821 | 2/1980 | Elias | 72/862.31 |
| 4,213,333 | 7/1980 | Krieger et al. | 73/862.31 |
| 4,281,538 | 8/1981 | Dudek | 73/862.21 |

*Primary Examiner*—David L. Lacey

*Attorney, Agent, or Firm*—Georges A. Maxwell

[57] ABSTRACT

A torque wrench structure comprising a reduction gear train within a case. The gear train includes an input shaft with an end accessible at the exterior of the case and an output shaft, a work engaging part at the exterior of the case concentric with the output shaft and coupling structure drivingly coupling the work engaging part with the output shaft. A reaction part with a body portion having a central opening freely accommodating said coupling structure is positioned adjacent the case. A plurality of circumferentially and radially spaced locking pins project from the body and engage in lock pin receiving structure in a part to be worked upon by the wrench. A plurality of circumferentially spaced elongate deflection beams project from the body and engaging stops on the case. Strain gauges are fixed to the deflection beams between the stops and the body. A bridge circuit with a digital readout is connected with the strain gauges to compare the resistance of said gauges and to display digits corresponding to the forces transmitted by the wrench through said work engaging part.

20 Claims, 9 Drawing Figures

TORQUE MULTIPLYING TORQUE WRENCH

This invention has to do with an improved torque multiplying torque wrench.

BACKGROUND OF THE INVENTION

In the art of torque wrenches and similar tools provided to apply predetermined torsional forces onto and through threaded fasteners and the like in various structures and machines, there is a special class of torque multiplying and force indicating wrench which is provided to apply torque to fasteners of particular machines, which is such that parts of the machines, adjacent the fastenrs, establish the reaction parts or structures necessary to generate the required torsional forces. That is, the applied torsional forces are generated between the fasteners and adjacent related reactive structure, not between the fasteners and some remote unrelated reaction structures.

The above noted special class of torque wrench typically includes a case housing a suitable torque multiplying drive means with torque input and output members or parts, work or fastener engaging parts, such as drive sockets, drivingly engaged with and between the torque output part and a related fastener and a reaction member or part in driving engagement with and between the case of the wrench and the structure with which the fastener is related. Further, the torque which is applied by such wrenches is typically measured by force indicating means engaged with and between the reaction parts and the wrench cases.

The most common prior art wrench of the special class here concerned with is that wrench which is disclosed in U.S. Pat. No. 3,683,686 for "MECHANICAL TORQUE WRENCH AND HYDRAULIC READOUT THEREFOR", issued Aug. 15, 1972.

In the above noted prior art wrench structure, the reaction part is an annular part with a central opening which freely rotatably accommodates an output spindle of the wrench which is adapted to be drivingly coupled to a related fastener by means of a drive socket or the like. The reaction part has a pair of lock pins which engage in lock pin receiving sockets or openings in the machine or structure with which the fastener to be worked upon is related and has a pair of opposite, radially outwardly projecting lever arms. The lever arms extend freely between related pairs of spaced stop posts formed on the wrench case. The lever arms carry fluid filled bellows and the stop posts have adjustable stops to engage the bellows whereby relative rotation of the reaction part and the wrench case results in the exerting of forces on the bellows. The bellows are connected with a suitable hydraulic pressure gauge which indicates the forces applied to the bellows and which is calibrated to indicate the forces applied by the wrench structure onto a fastener worked upon thereby.

While the above noted prior art wrench has proven to be serviceable, the hydraulic force sensing and indicating means thereof is not nearly so accurate as are most other kinds and classes of high quality torque indicating wrenches and tools. The hydraulic force sensing and readout means noted above is fragile and subject to being damaged or otherwise adversely affected in normal use and handling of the noted wrench structure.

The general acceptance and use of the noted prior art wrench structure in industry is believed and understood to be due to the fact that no other like or similar wrench structure with other or different force indicating and readout means has been developed by the prior art and made available.

OBJECTS AND FEATURES OF THE INVENTION

It is an object of our invention to provide an improved, more accurate, more durable and more dependable torque wrench structure of the special class referred to in the preceding.

It is another object and a feature of this invention to provide an improved torque wrench of the special class referred to above which avoids the provision and use of a rather inaccurate, fragile and independable hydraulic force sensing and readout means engaged between opposing force transmitting parts of the wrench structure and to provide force transmitting deflection beams in the force transmitting structure of the wrench and related electrical means for accurately measuring the deflection of those beams and transposing the measured deflection of the beams into force measurements which accurately correspond to the forces applied by the wrench structure onto a fastener worked upon by it.

Another object and feature of our invention is to provide an improved torque wrench of the special class referred to above which includes a reaction part releasably engaging and in stopped engagement with the structure with which the fastener being worked upon is related and having a pair of opposite radially outwardly projecting deflection beams with outer free ends engaged with reaction stop parts on the case of the wrench structure and force measuring and indicating means including strain gauges on and responding to deflection of the deflection beams and connected with an electric circuit with digital readout means which accurately indicate the forces applied by the wrench onto the fastener worked upon thereby.

An object and feature of our invention is to provide an improved torque wrench structure of the special class referred to above which, but for its inclusion of deflection beams and novel electric means for measuring the deflection of the beams and accurately indicating the forces applied by the wrench on to a related fastener or the like, fairly meets or exceeds all government and industrial specifications for wrenches of the same special class with respect to accuracy, size, weight and all significant working dimensions.

Finally, it is an object and feature of our invention to provide a torque wrench structure of the general class and character referred to above which is no more costly to make, easier and more economical to service and maintain, and more accurate and dependable in operation than those wrenches of the same class provided by the prior art.

The foregoing and other objects and features of our invention will be apparent and fully understood from the following description of one typical preferred form and application of our invention, throughout which description reference is made to the accompanying drawings.

DESCRIPTION OF THE DRAWINGS

FIG. 7 is a sectional view taken substantially as indicated by line 7—7 on FIG. 6;

DESCRIPTION OF THE INVENTION

Figure 1:
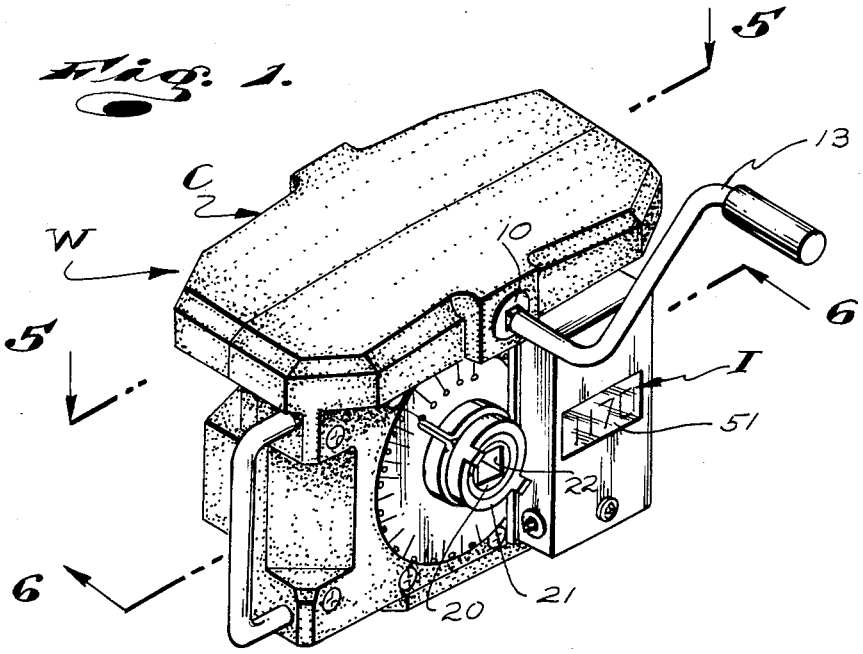
FIG. 1 is an isometric view of our new wrench structure showing the front, one side and one end thereof.

Referring to the drawings, the wrench W that we provide includes a case C comprised of front and rear sections of cast metal and in which a suitable gear train T is arranged and supported.

Figure 5:
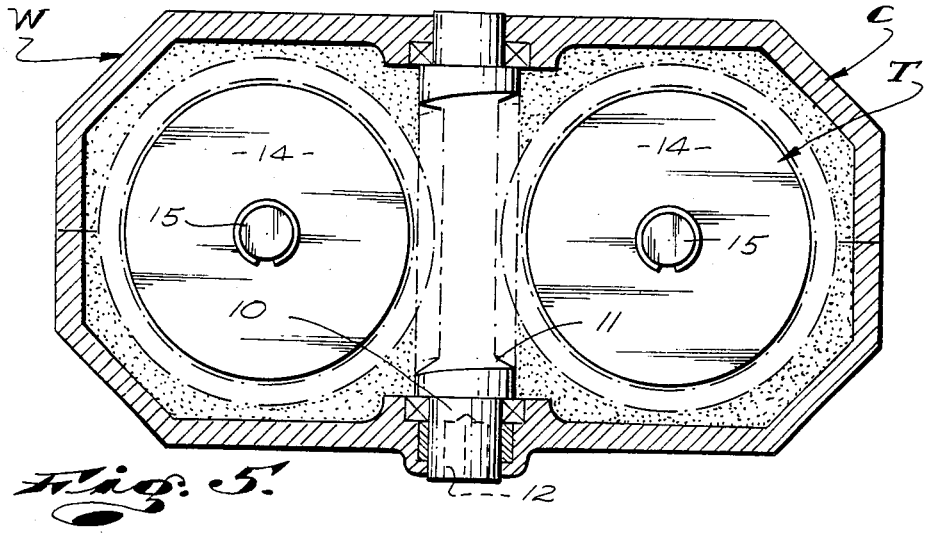
FIG. 5 is an enlarged sectional view taken substantially as indicated by line 5—5 on FIG. 1.

Referring to FIGS. 1 and 5 of the drawings, the gear train T includes an elongate input shaft 10 with front and rear ends suitably bearing supported in the case, as indicated. The shaft 10 is formed with or carries an input worm gear 11, intermediate its ends. The front end of the shaft 10 is accessible at the front of the case C and has a polygonal socket opening 12 in which a hand crank 13 is releasably engaged.

Figure 6:
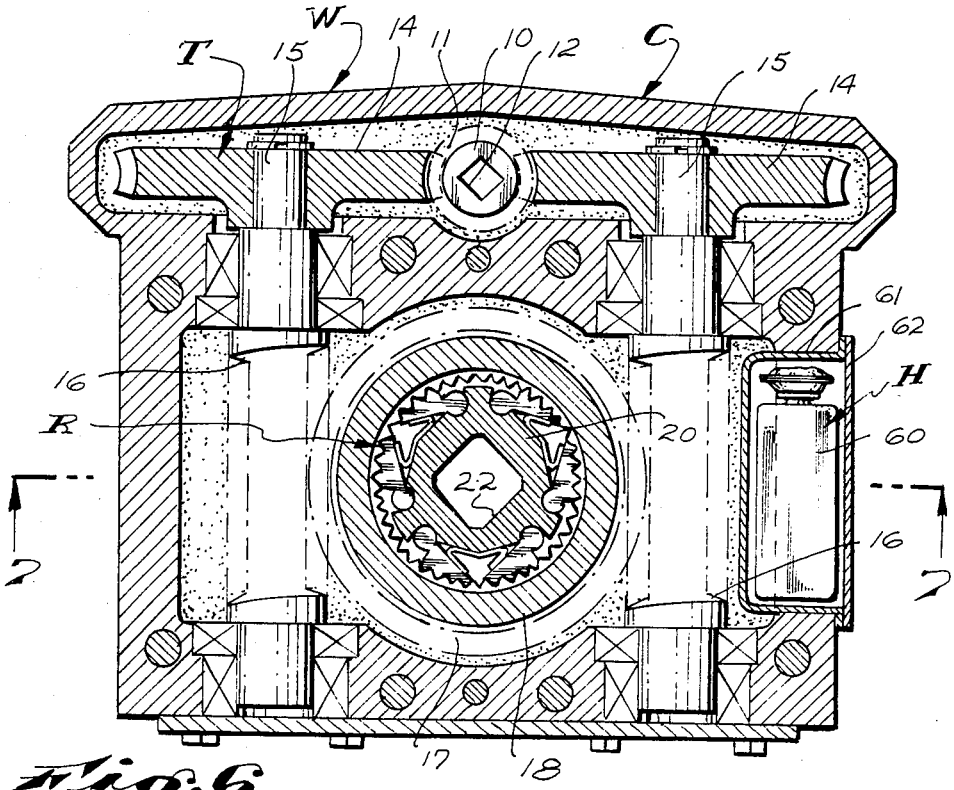
FIG. 6 is a sectional view taken substantially as indicated by line 6—6 on FIG. 1.
Figure 2:
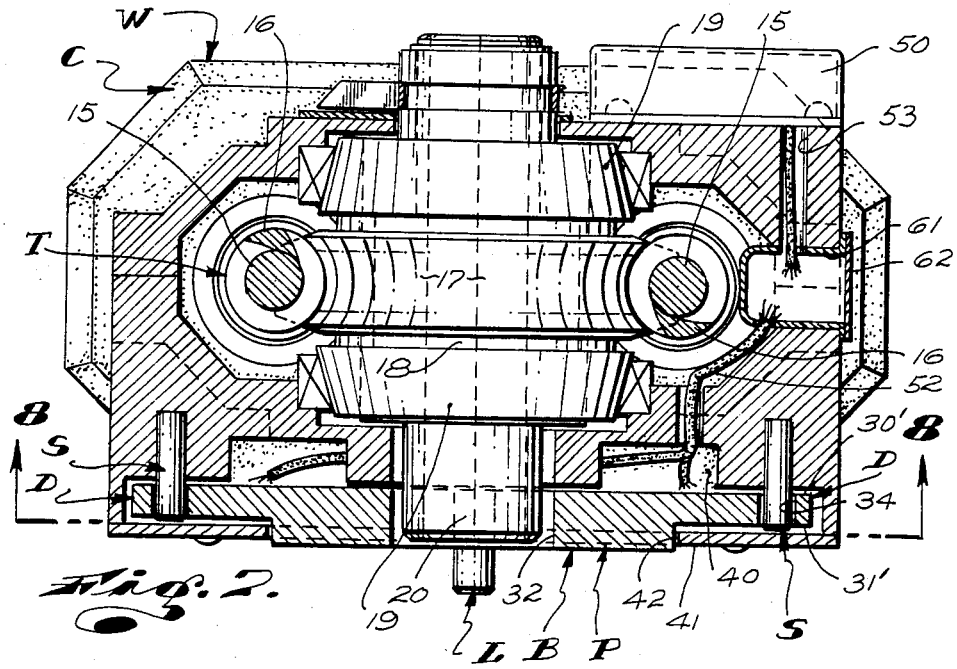

The worm gear 11 occurs between and drivingly engages a pair of spaced apart driven gear wheels 14 on elongate shafts 15. The shafts 15 are on axes normal to and spaced laterally outward from the opposite sides of the shaft 10 and are suitably bearing supported within and by the case by suitable bearing assemblies spaced longitudinally thereof and as best shown in FIG. 6 of the drawings.

The shafts 15 (between the bearing assemblies therefor) are formed with or drivingly carry driven worm gears 16. The worm gears 16 drivingly engage opposite sides of an elongate central output gear wheel 17 formed or drivingly carried by a central tubular output shaft 18.

The output shaft 18 is on an axis normal to and spaced between the shafts 15 and which is parallel with and spaced from the input shaft 10.

The gear wheel 17 occurs substantially intermediate the front and rear ends of the tubular shaft 18, between a pair of large bearing cones 19 on the shaft 18. The bearing cones 19 are supported in and by the case by suitable antifriction bearings, as clearly shown in the drawings.

The shaft 18 freely receives an elongate central drive spindle 20 with front and rear ends which are accessible at the front and rear ends of the case C. The spindle 20 is drivingly coupled with the shaft 18 by a suitable releasable and selectively reversible ratchet drive means R whereby the spindle 20 is concentric with the shaft 18 and is driven directly by the shaft 18 in a clockwise or counterclockwise direction, as desired or as circumstances require.

In practice, the front end of the spindle projects forward from the case C a sufficient distance to enable manual engagement thereof and the ratchet means R is such that by manually engaging the front end portion of the spindle, the spindle and a fastener driven thereby can be manually turned relative to the remainder of the wrench structure to, for example, advance the fastener to fingertight set position, preparatory to tightening it.

It is to be noted at this time that the exact nature and construction of the ratchet means R can vary widely in practice without departing from the broad aspects and spirit of our invention. In accordance with the foregoing, we have elected not to unduly burden this disclosure with detailed description of the ratchet means R and will keep further reference to that means to a minimum.

The basic form of ratchet means that we employ is shown in FIG. 6 of the drawings. Releasing and reversing the ratchet means is effected by a manually engageable operating sleeve 21 engaged about the forward end portion of the spindle and accessible at the front of the case C.

The spindle 20 has a central polygonal through opening 22 in and through which the polygonal drive stem or shaft of a work-engaging tool, such as a drive socket, (not shown) positioned at and projecting freely from the back side of the case C can be releasably engaged.

In our reduction to practice of the present invention, the gear train T has a gear ratio of 800 to 1 and is such that great torsional force can be delivered by the spindle 20 to a piece of work, upon repeated turning of the crank 13 with little force or resistance.

In practice, the details of construction of the case and gear train T, illustrated and thus far described, can vary widely without departing from or affecting the novelty of our invention. Accordingly, we have elected to treat that structure which has thus far been described in a brief and general manner so as not to undly burden this disclosure.

Figure 2:
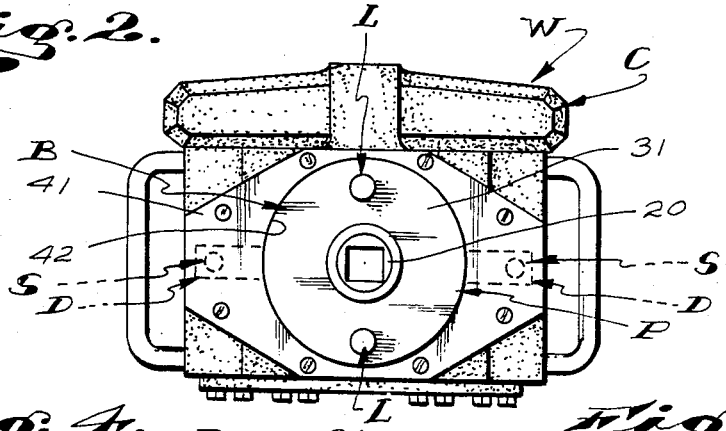
FIG. 2 is a back view of the wrench.
Figure 4:
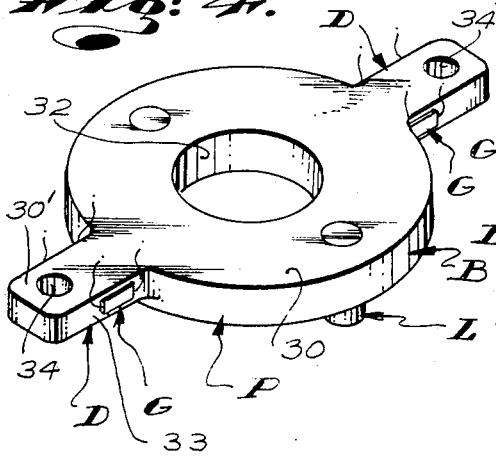
FIG. 4 is an isometric view of the reaction part showing the front, other side and other end thereof.
Figure 3:
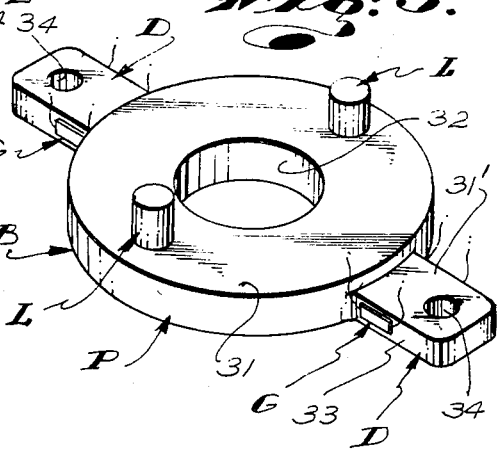
FIG. 3 is an isometric view of the reaction part that we provide showing back, one side and one end thereof.

In furtherance of our invention, the wrench structure W that we provide includes a reaction part P which is shown separate in FIGS. 3 and 4 of the drawings. The part P is shown embodied in the invention in FIGS. 2, 7 and 8 of the drawings.

The part P comprises a flat annular disc-shaped body B with front and rear surfaces 30 and 31 and a central through opening 32. The body B has and/or carries a pair of rearwardly projecting lock pins L spaced radially outward from the rear surface 31 in radial outward spaced relationship from the opposite sides of the central axis of the body. The lock pins L project freely from the rear surface of the body and from the rear of the case C to engage in lock pin receiving sockets (not shown) provided in the structure with which the fastener to be worked upon is related. That is, in structures or machines with fasteners or other parts which are to be tightened with the wrench that we provide, the structures or machines are provided with lock pin receiving sockets (or equivalents thereof) in predetermined circumferential and radial spaced relationship from the axes of the fasteners or parts to be worked upon and in which the lock pins L can be releasably engaged.

In addition to the foregoing, the body B of part P is formed with or has fixed to it and carries two diametrically opposite radially outwardly projecting deflection beams D. The deflection beams D are shown as elongate, flat bar-like members or parts with flat front and rear surfaces 30′ and 31′ and flat, straight opposite side edges 33.

The outer free end portions of the deflection beams D are provided with stop pin receiving openings 34 in and through which stop pins S fixed to and projecting rearwardly from the case C are freely engaged.

In carrying out of our invention and as shown in the drawings, the rear side of the case C is formed with a rearwardly opening cavity or recess 40 to freely accommodate the reaction part P. The cavity 40 is normally substantially covered by a cover plate 41 which is releasably screw fastened to the rear of the body and which serves to suitably retain the part P. Further, as shown, the central body portion B of the part P projects rearwardly through a central opening 42 in the cover plate 40 so that its rear surface 31 is rearward of the case C and the plate 41 and so that its lock pins L are fully accessible.

With the structure described above, it will be apparent that when the wrench W is in use, the lock pins L, engaged in lock pin sockets in a related structure or machine, orient the wrench W in alignment with the fastener or part related to said sockets and lock the reaction part P against rotation relative to the machine or structure with which the fastener is related. Further, the stop pins S, carried by the case and engaged in the openings 34 in the outer ends of the deflection beams D of the part P, lock or stop the case C against rotation relative to the part P and therefore against rotation relative to the work structure or machine. Accordingly, the reaction between the fastener and the wrench is imparted directly to the work structure or machine in which the lock pins L are engaged, through the reaction part P.

It will be further apparent that the reactive forces directed in and through the reaction part P are directed in and through the deflection beams D thereof and cause those beams to deflect laterally between the stop pins S and the body B of the part P.

In addition to the foregoing, the reaction part P includes strain gauges G fixed to the deflection beams D between the stop pins S and the body B of the part P. The strain gauges G are in the nature of variable resisters, the resistance of which varies as they are worked and/or deformed in response to deflection or bending of the beams D on which they are fixed.

The strain gauges G are connected in an electric circuit E which can be in the nature of or be defined generally as a bridge circuit, which functions to compare the resistance of the gauges G and which transmits a resultant signal to an indicator device I which transposes the resultant signal to indicate the work forces to which the beams D and gauges G are subjected; which are the forces directed by the wrench onto the work.

Figure 8:
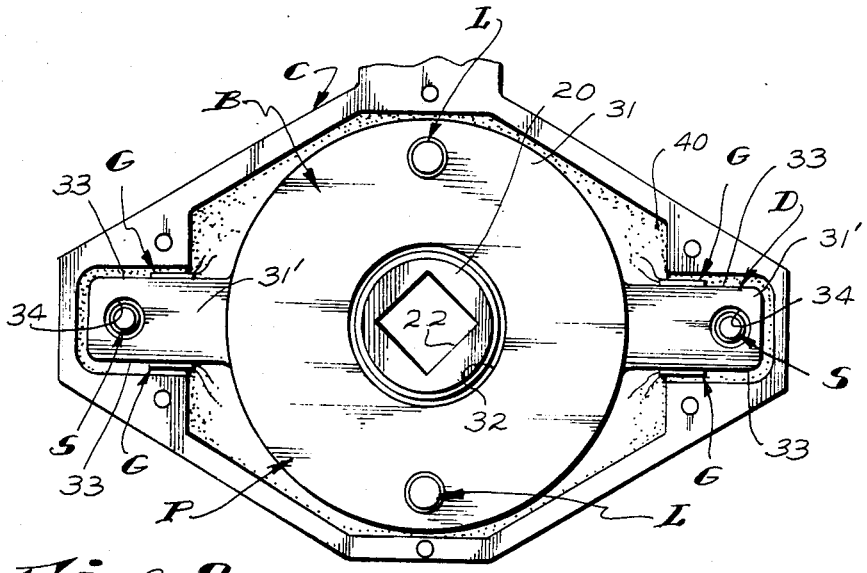
FIG. 8 is a sectional view taken substantially as indicated by line 8—8 on FIG. 7.

In the preferred carrying out of our invention, we provide four strain gauges G, one fixed to each side 33 of each deflection beam D, as clearly shown in FIGS. 3, 4 and 8 of the drawings. The strain gauges G occur in lateral spaced relationship from the central longitudinal axes of their related beams B and are such that upon deflection of the beams D, laterally relative to their radially extending longitudinal axes, one gauge on each beam is subjected to tensile forces and the other subject to compressive forces. That is, whenever the wrench structure is put to use, all four gauges function, two being subjected to tensile forces and two being subjected to compressive forces. With such a combination and relationship of two deflection beams and four strain gauges, cooperatively related by a common bridge circuit, the gauges G are functionally balanced by the circuit and the resultant output signal of the circuit accurately corresponds to the forces to which the deflection beams and gauges are subjected and is symmetrical, that is, it is balanced and accurate in response to deflection of the beams D in directions clockwise or counter-clockwise relative to the central axis of the part B.

In furtherance of our invention, the indicator device I is an electric digital display device made to display forces in any desired unit of force. For example, it can be made to display foot pounds of force and is such that it accurately displays those forces in one-tenth pound increments if desired.

It is to be noted at this time that such a digital display device is notably more accurate and dependable than common hydraulic pressure gauges such as are commonly provided on prior art wrenches of the class here concerned with. In the case of ordinary hydraulic pressure gauges which are characterized by calibrated dial cards and pivotally mounted indicator dial arms, the effective size, number and/or spacing of the calibrations is notably limited and the likelihood of error reading of such dial type gauges, as a result of parallax and the like, is great. In the case of the above noted prior art wrenches, the pressure gauges are calibrated to no less than 25 foot pounds of force and due to parallax and the like, dependable reading of those dial gauges requires that one allow for error reading of plus or minus 25 foot pounds.

With our digital readout device I, as employed, the above noted shortcomings found to exist in dial type pressure gauges are eliminated and accurate reading in certain increments, such as one foot pound, is assured.

Figure 9:
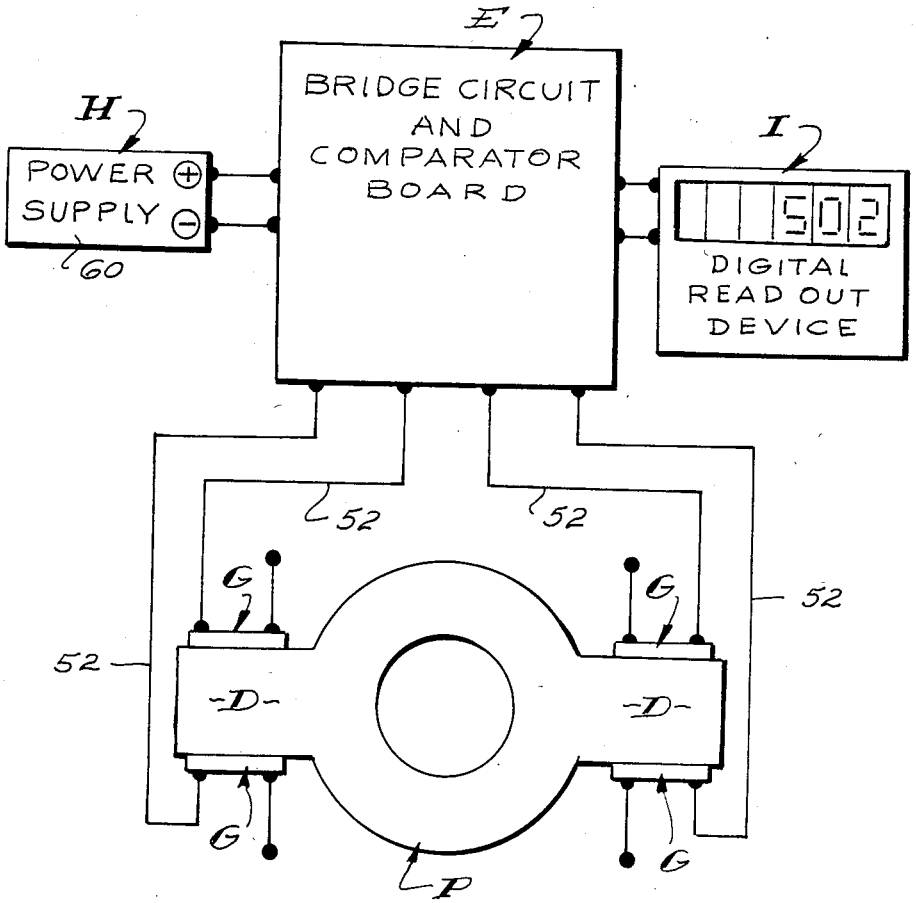
FIG. 9 is a circuit block diagram.

The exact nature and form of the electric circuit E which occurs between the noted strain gauges G and the digital readout device I is not our invention, but rather, is a circuit designed and developed by others for embodiment in our wrench structure and which is provided as a finished component for inclusion in our wrench structure. Accordingly, in FIG. 9 of the drawings, we show a block diagram of the circuit utilized in reducing our invention to practice, we have elected not to undertake and offer a full and detailed explanation and/or description of that circuit. It is sufficient to note that the circuit shown in FIG. 9 of the drawings illustrates that circuit which we employ and which has proven to be highly effective and dependable in carrying out our invention. It is understood and believed that the subject circuit, in generic terms, is a bridge circuit or is in the nature of or the equivalent of a bridge circuit and will, for the purposes of this disclosure, be referred to and claimed as a suitable bridge circuit.

The subject circuit E includes a small compact circuit board which carries certain of the electrical components making up the circuit. The circuit board is housed in a canister 50 mounted on the front of the case C, as shown in FIGS. 1 and 7 of the drawings. The digital readout device I of the circuit E is mounted in the canister 50 and is visible through a window 51 at the front of the canister 50, as clearly shown in FIG. 1 of the drawings. The strain gauges G, fixed to the deflection beam D of the part P, are connected with the circuit board by conductors 52 which extend from the gauges through the cavity 40 in the case C and through suitable openings or tunnels 53 drilled in the case C, as shown in FIG. 7 of the drawings.

In the form of the invention illustrated, a power supply H for the circuit is carried within the case C. The power supply H is shown as including a dry cell battery 60 enaged in a battery box 61 set in an opening formed in one end of the case C, as shown in FIGS. 6 and 7 of the drawings. The box 61 is normally closed by a releasable cover or lid 62.

In light of the foregoing, it will be apparent that our novel reaction part P, with its pair of deflection beams D related strain gauges G and electric circuit E, with digital force indicating device I, imparts novelty into the whole of the wrench structure disclosed and results in an improved torque wrench structure which constitutes a notable advance in the art of torque wrenches.

Having described only one typical preferred form and carrying out of our invention, we do not wish to be limited to the specific details herein set forth, but wish to reserve to ourselves any modifications and/or variations that might appear to those skilled in the art and which fall within the scope of the following claims:

Having described our invention, we claim:

1. A torque wrench structure comprising a case, a reduction gear train within and supported by the case and including an input shaft with an end accessible at the exterior of the case and an output shaft, a work engaging part at the exterior of the case concentric with the output shaft, coupling means drivingly coupling the work engaging part to the output shaft, a reaction part with a body portion with a central axis concentric with the output shaft and having an opening freely accommodating said coupling means, a plurality of elongate locking pins in predetermined circumferential and radial spaced relationship about the central axis of and projecting freely from the body portion and from the case to engage in lock pin receiving means of a related reaction structure related to a part to be worked upon by the wrench, a plurality of elongate deflection beams spaced circumferentially about the central axis of and projecting radially outward from the body portion, stop means between the outer ends of the deflection beams and the case to stop circumferential turning of the reaction part relative to the case, strain gauges fixed to the deflection beams between the stop means and the body portion, a bridge circuit connected with the strain gauges and comparing the resitance of said gauges and transmitting a resultant signal and a digital readout device connected with the bridge circuit and receiving the resultant signal and displaying digits corresponding to the forces transmitted by the wrench through said work engaging part thereof.

2. The torque wrench structure set forth in claim 1 wherein the case includes a cavity in which the reaction part is positioned and has an opening adjacent the body portion of said part and from which the lock pins project.

3. The torque wrench structure set forth in claim 1 wherein the plurality of lock pins includes two lock pins at diametrically opposite sides of and spaced radially outward from the axis of said body portion.

4. The torque wrench structure set forth in claim 3 wherein each of the deflection beams have opposite sides spaced laterally from their central radially extending longitudinal axes and wherein a strain gauge is fixed to each of said opposite sides of each beam.

5. The torque wrench structure set forth in claim 1 wherein the plurality of deflection beams includes two deflection beams spaced apart 180° circumferentially of and projecting radially outward from opposite sides of the body portion.

6. The torque wrench structure set forth in claim 5 wherein each of the deflection beams have opposite sides spaced laterally from their central radially extending longitudinal axes and wherein a strain gauge is fixed to each of said opposite sides of each beam.

7. The torque wrench structure set forth in claim 1 wherein the plurality of lock pins includes two lock pins spaced 180° apart at diametrically opposite sides of and spaced radially outward from the axis of said body portion and the plurality of deflection beams includes two deflection beams spaced 180° apart projecting radially outward from opposite sides of the body portion.

8. The torque wrench structure set forth in claim 7 wherein each of the deflection beams have opposite sides spaced laterally from their central radially extending longitudinal axes and wherein a strain gauge is fixed to each of said opposite sides of each beam.

9. The torque wrench structure set forth in claim 8 wherein said stop means includes stop pins supported by the case and engaged with the deflection beams.

10. The torque wrench structure set forth in claim 7 wherein said stop means includes stop pins supported by the case and engaged with the deflection beams.

11. The torque wrench structure set forth in claim 1 wherein each of the deflection beams have opposite sides spaced laterally from their central radially extending longitudinal axes and wherein a strain gauge is fixed to each of said opposite sides of each beam.

12. The torque wrench structure set forth in claim 11 wherein said stop means includes stop pins supported by the case and engaged with the deflection beams.

13. The torque wrench structure set forth in claim 1 wherein said stop means includes stop pins supported by the case and engaged with the deflection beams.

14. The torque wrench structure set forth in claim 1 wherein the reduction gear train includes a drive worm gear on the input shaft, a pair of driven gear wheels on driven shafts supported by the case engaging opposite sides of and driven by the drive worm gear, driven worm gears on said driven shafts and engaged with opposite sides of a central output gear wheel on the output shaft.

15. The torque wrench structure set forth in claim 1 wherein said coupling means drivingly coupling the work engaging part to the output shaft includes an elongate central spindle freely engaged in a central opening in the output shaft, selectively reversible ratchet means drivingly engaged with and between the spindle and the output shaft, said spindle has rotary driving connecting means releasably connecting the work engaging part thereto.

16. The torque wrench structure set forth in claim 1 wherein the reduction gear train includes a drive worm gear on the input shaft, a pair of driven gear wheels on driven shafts supported by the case engaging opposite sides of and driven by the drive worm gear, driven worm gears on said driven shafts and engaged with opposite sides of and driving a central output gear wheel on the output shaft, said coupling means drivingly coupling the work engaging part to the output shaft includes an elongate central spindle freely engaged in a central opening in the output shaft, selectively reversible ratchet means drivingly engaged with and between the spindle and the output shaft, said spindle has rotary driving connecting means releasably connecting the work engaging part thereto.

17. The torque wrench structure set forth in claim 1 wherein the reduction gear train includes a drive worm gear on the input shaft, a pair of driven gear wheels on driven shafts supported by the case engaging opposite sides of and driven by the drive worm gear, driven worm gears on said driven shafts and engaged with opposite sides of and driving a central output gear wheel on the output shaft between and driven by the driven worm gears, said coupling means drivingly coupling the work engaging part to the output shaft includes an elongate central spindle freely engaged in a central opening in the output shaft, selectively reversible ratchet means drivingly engaged with and between the spindle and the output shaft, said spindle has rotary driving connecting means releasably connecting the work engaging part thereto, the reaction part has two lock pins spaced 180° apart and at diametrically opposite sides of and spaced radially outward from the axis of said body portion.

18. The torque wrench structure set forth in claim 1 wherein the reduction gear train includes a drive worm gear on the input shaft, a pair of driven gear wheels on driven shafts supported by the case engaging opposite sides of and driven by the drive worm gear, driven worm gears on said driven shafts and a central output gear wheel on the output shaft engaged with and between and driven by the driven worm gears, said coupling means drivingly coupling the work engaging part to the output shaft includes an elongate central spindle freely engaged in a cdntral opening in the output shaft, selectively reversible ratchet means drivingly engaged with and between the spindle and the output shaft, said spindle has rotary driving connecting means releasably connecting the work engaging part thereto, the plurality of lock pins includes two lock pins spaced 180° apart and at diametrically opposite sides of and spaced radially outward from the axis of said body portion, the plurality of deflection beams includes two deflection beams spaced 180° apart and projecting radially outward from opposite sides of the body.

19. The torque wrench structure set forth in claim 1 wherein the reduction gear train includes a drive worm gear on the input shaft, a pair of driven gear wheels on driven shafts at opposite sides of and driven by the drive worm gear, driven worm gears on the driven shafts and a central output gear wheel on the output shaft between and driven by the driven worm gears, said coupling means drivingly coupling the work engaging part to the output shaft includes an elongate central spindle freely engaged in a central opening in the output shaft, selectively reversible ratchet means drivingly engaged with and between the spindle and the output shaft, said spindle has rotary driving connecting means releasably connecting the work engaging part thereto, the plurality of lock pins include two lock pins spaced 180° apart and at diametrically opposite sides of and spaced radially outward from the axis of said body portion, the plurality of deflection beams includes two deflection beams spaced 180° apart and projecting radially outward from opposite sides of the body portion, each of the deflection beams have opposite sides spaced laterally from their central radially extending longitudinal axes, a strain gauge is fixed to each opposite side of each beam.

20. The torque wrench structure set forth in claim 1 wherein the reduction gear train includes a drive worm gear on the input shaft, a pair of driven gear wheels on driven shafts supported by the case engaging opposite sides of and driven by the drive worm gear, driven worm gears on said driven shafts and engaged with opposite sides of and driving a central output gear wheel on the output shaft, said coupling means drivingly coupling the work engaging part to the output shaft includes an elongate central spindle freely engaged in a central opening in the output shaft, selectively reversible ratchet means drivingly engaged with and between the spindle and the output shaft, said spindle has rotary driving connecting means releasably connecting the work engaging part thereto, the plurality of lock pins includes two lock pins spaced 180° apart and at diametrically opposite sides of and spaced radially outward from the axis of said body portion, the plurality of deflection beams includes two deflection beams spaced 180° apart and projecting radially outward from opposite sides of the body, each of the deflection beams have opposite sides spaced laterally from their central radially extending longitudinal axes, a strain gauge is fixed to each opposite side of each beam, said stop means includes top pins engaged with and between the case and the deflection beams.

* * * * *